US011358047B2

(12) United States Patent
Cheng et al.

(10) Patent No.: US 11,358,047 B2
(45) Date of Patent: Jun. 14, 2022

(54) SKATEBOARD AND CONTROL METHOD THEREOF

(71) Applicant: Beijing Xiaomi Mobile Software Co., Ltd., Beijing (CN)

(72) Inventors: Liang Cheng, Beijing (CN); Yongfeng Xia, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 337 days.

(21) Appl. No.: 16/419,843

(22) Filed: May 22, 2019

(65) Prior Publication Data

US 2019/0366193 A1 Dec. 5, 2019

(30) Foreign Application Priority Data

Jun. 5, 2018 (CN) ..... 201810569941.5

(51) Int. Cl.
*A63C 17/12* (2006.01)
*A63C 17/01* (2006.01)
*A63C 17/14* (2006.01)

(52) U.S. Cl.
CPC ..... *A63C 17/12* (2013.01); *A63C 17/011* (2013.01); *A63C 17/14* (2013.01)

(58) Field of Classification Search
CPC ..... A63C 17/01; A63C 17/12; A63C 17/011
See application file for complete search history.

(56) References Cited

U.S. PATENT DOCUMENTS 6,050,357 A 4/2000 Staelin et al.
7,363,993 B2 * 4/2008 Ishii ..... B62D 37/00 180/7.1

(Continued)

FOREIGN PATENT DOCUMENTS

CN 1730310 A 2/2006
CN 101932365 A 12/2010

(Continued)

OTHER PUBLICATIONS

Chinese Office Action dated Nov. 11, 2019, in Patent Application No. 201810569941.5, 11 pages.

(Continued)

*Primary Examiner* — Brian L Swenson
(74) *Attorney, Agent, or Firm* — Oblon, McClelland, Maier & Neustadt, L.L.P.

(57) ABSTRACT

The disclosure relates to a skateboard and control method thereof. A skateboard deck is fixed on an axle of the skateboard, and a first sensor group and a second sensor group are sequentially arranged on the skateboard deck in a width direction. The method includes acquiring a first pressure value of the first sensor group and a second pressure value of the second sensor group; controlling the skateboard to turn to a first direction when the first pressure value is greater than the second pressure value and a difference value between the first pressure value and the second pressure value is greater than a first threshold, and controlling the skateboard to turn to a second direction when the second pressure value is greater than the first pressure value and a difference value between the second pressure value and the first pressure value is greater than a second threshold.

18 Claims, 3 Drawing Sheets

(56) References Cited

U.S. PATENT DOCUMENTS

| | | | | |
|---|---|---|---|---|
| 9,302,173 | B2 * | 4/2016 | DiCarlo | A63C 17/012 |
| 9,452,345 | B2 * | 9/2016 | Doerksen | A63C 17/014 |
| 9,987,547 | B2 * | 6/2018 | Ruschkowski | A63C 17/12 |
| 10,160,503 | B1 * | 12/2018 | Zheng | A63C 17/017 |
| 10,343,052 | B2 * | 7/2019 | Wood | B60L 50/60 |
| 2005/0121238 | A1 | 6/2005 | Ishii | |
| 2012/0232734 | A1 * | 9/2012 | Pelletier | A63C 17/12 701/22 |
| 2018/0250581 | A1 * | 9/2018 | Lemire-Elmore | A63C 17/015 |
| 2018/0264972 | A1 * | 9/2018 | Pang | A63C 17/02 |

FOREIGN PATENT DOCUMENTS

| | | | |
|---|---|---|---|
| CN | 105169687 | A | 12/2015 |
| CN | 105344090 | A | 2/2016 |
| CN | 106314201 | A | 1/2017 |
| CN | 107961526 | A | 4/2018 |
| EP | 1 529 556 | A2 | 5/2005 |
| EP | 1 630 086 | A1 | 3/2006 |
| JP | 2003-237670 | A | 8/2003 |

OTHER PUBLICATIONS

Extended European Search Report dated Oct. 25, 2019, in Patent Application No. 19178083.2, 8 pages.

Combined Chinese Office Action and Search Report dated Aug. 16, 2019, in Patent Application No. 201810569941.5, 27 pages (with English translation).

Combined Chinese Office Action and Search Report dated Aug. 16, 2019, in Patent Application No. 201810569941.5, 24 pages (with English translation).

* cited by examiner

SKATEBOARD AND CONTROL METHOD THEREOF

CROSS-REFERENCE TO RELATED APPLICATIONS

This application is based on and claims priority to Chinese Patent Application No. 201810569941.5, filed on Jun. 5, 2018, the entire contents of which are incorporated herein by reference.

TECHNICAL FIELD

The present disclosure relates to the field of skateboard control, and more particularly, to a skateboard and control method thereof.

BACKGROUND

Skateboarding, as an originator of extreme sports, is very popular among extreme sports enthusiasts and young people. In the daily life, skateboards are often used as a means of transportation. In a process of using a skateboard, how to flexibly control the direction of the skateboard is a basic skill necessary for a user.

In a traditional skateboard or an electric skateboard, a skateboard deck of the skateboard is movably connected to an axle. That is, the skateboard deck is not fixed, and an angle between the skateboard deck and the axle is changeable, so that the skateboard deck can flexibly incline to any of the two sides of the skateboard. In a process of controlling the direction of the skateboard, the user controls the skateboard to turn left or right by inclining the skateboard deck towards any of the two sides of the skateboard. Meanwhile, the user needs to control his body to maintain balance with the skateboard to avoid falling down.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide a skateboard control method, applied to a skateboard, wherein a skateboard deck of the skateboard is fixed on an axle of the skateboard, and a first sensor group and a second sensor group are sequentially arranged on the skateboard deck in a width direction. The method includes acquiring a first pressure value of the first sensor group and a second pressure value of the second sensor group; controlling the skateboard to turn to a first direction when the first pressure value is greater than the second pressure value and a difference value between the first pressure value and the second pressure value is greater than a first threshold, wherein the first direction is a direction of the first sensor group relative to the second sensor group; and controlling the skateboard to turn to a second direction when the second pressure value is greater than the first pressure value and a difference value between the second pressure value and the first pressure value is greater than a second threshold, wherein the second direction is a direction of the second sensor group relative to the first sensor group.

In an example, a third sensor group and a fourth sensor group are sequentially arranged on the skateboard deck in a length direction, the third sensor group is arranged at a front half part of the skateboard deck, the fourth sensor group is arranged at a rear half part of the skateboard deck. According to an aspect, the method further includes acquiring a third pressure value of the third sensor group and a fourth pressure value of the fourth sensor group; controlling the skateboard to move forward when the third pressure value is greater than the fourth pressure value and a difference value between the third pressure value and the fourth pressure value is greater than a third threshold; and controlling the skateboard to brake when the fourth pressure value is greater than the third pressure value and a difference value between the fourth pressure value and the third pressure value is greater than a fourth threshold.

According to another aspect, the first, second, third, and fourth sensor groups cover a preset standing area of the skateboard deck, the first sensor group includes a first sensor and a second sensor, the second sensor group includes a third sensor and a fourth sensor, the third sensor group includes the first sensor and the third sensor, and the fourth sensor group includes the second sensor and the fourth sensor, the first pressure value is a sum of pressure values of the first sensor and the second sensor, the second pressure value is a sum of pressure values of the third sensor and the fourth sensor, the third pressure value is a sum of pressure values of the first sensor and the third sensor, and the fourth pressure value is a sum of pressure values of the second sensor and the fourth sensor.

According to yet another aspect, when controlling the skateboard to turn to the first direction, the method includes determining a first turning angle corresponding to the difference value between the first pressure value and the second pressure value, and controlling the skateboard to turn to the first direction based on the first turning angle; and when controlling the skateboard to turn to the second direction, the method includes determining a second turning angle corresponding to the difference value between the second pressure value and the first pressure value, and controlling the skateboard to turn to the second direction based on the second turning angle.

According to yet another aspect, when controlling the skateboard to turn to the first direction, the method includes determining a first turning speed corresponding to the difference value between the first pressure value and the second pressure value, and controlling the skateboard to turn to the first direction based on the first turning speed; and when controlling the skateboard to turn to the second direction, the method includes determining a second turning speed corresponding to the difference value between the second pressure value and the first pressure value, and controlling the skateboard to turn to the second direction based on the second turning speed.

According to yet another aspect, when controlling the skateboard to move forward, the method includes determining a speed gear corresponding to the difference value between the third pressure value and the fourth pressure value; and controlling the skateboard to move forward at the speed gear, wherein a speed indicated by the corresponding speed gear is directly proportional to the difference value between the third pressure value and the fourth pressure value.

According to yet another aspect, when controlling the skateboard to brake, the method includes determining a braking torque corresponding to the difference value between the fourth pressure value and the third pressure value; and controlling the skateboard to brake based on the braking torque, wherein the corresponding braking torque is directly proportional to the difference value between the fourth pressure value and the third pressure value.

According to yet another aspect, the method further includes allowing the skateboard to slide when the pressure values of the first sensor group and the second sensor group are both greater than a preset starting value; prohibiting the skateboard from sliding when the pressure values of the first sensor group and the pressure value of the second sensor group are both less than the preset starting value; and prohibiting the skateboard from sliding when one of the pressure value of the first sensor group and the pressure value of the second sensor group is less than the preset starting value.

In an example, the skateboard further includes an electric motor that is configured to drive the skateboard to carry out an operation that is one of moving straight and turning, and the electric motor is arranged on the skateboard on a shaft portion of the axle and/or the electric motor is an annular motor embedded on an inner side of a wheel portion of the axle.

Aspects of the disclosure also provide a skateboard including an axle; a skateboard deck fixed on the axle; and a first sensor group and a second sensor group sequentially arranged on the skateboard deck in a width direction. The first sensor group is configured to acquire a first pressure value, and the second sensor group is configured to acquire a second pressure value. The skateboard is configured to turn to a first direction when the first pressure value is greater than the second pressure value and a difference value between the first pressure value and the second pressure value is greater than a first threshold, wherein the first direction is a direction of the first sensor group relative to the second sensor group. The skateboard is configured to turn to a second direction when the second pressure value is greater than the first pressure value and a difference value between the first pressure value and the second pressure value is greater than a second threshold, wherein the second direction is a direction of the second sensor group relative to the first sensor group.

Aspects of the disclosure also provide a non-transitory computer-readable storage medium having stored therein instructions that, when executed by a processor of a skateboard having a skateboard deck that is fixed on an axle of the skateboard, and a first sensor group and a second sensor group that are sequentially arranged on the skateboard deck in a width direction, cause the skateboard to acquire a first pressure value of the first sensor group and a second pressure value of the second sensor group; control the skateboard to turn to a first direction when the first pressure value is greater than the second pressure value and a difference value between the first pressure value and the second pressure value is greater than a first threshold, wherein the first direction is a direction of the first sensor group relative to the second sensor group; and control the skateboard to turn to a second direction when the second pressure value is greater than the first pressure value and a difference value between the second pressure value and the first pressure value is greater than a second threshold, wherein the second direction is a direction of the second sensor group relative to the first sensor group.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of this specification, illustrate aspects consistent with the present disclosure and, together with the description, serve to explain the principles of the present disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

Figure 1:
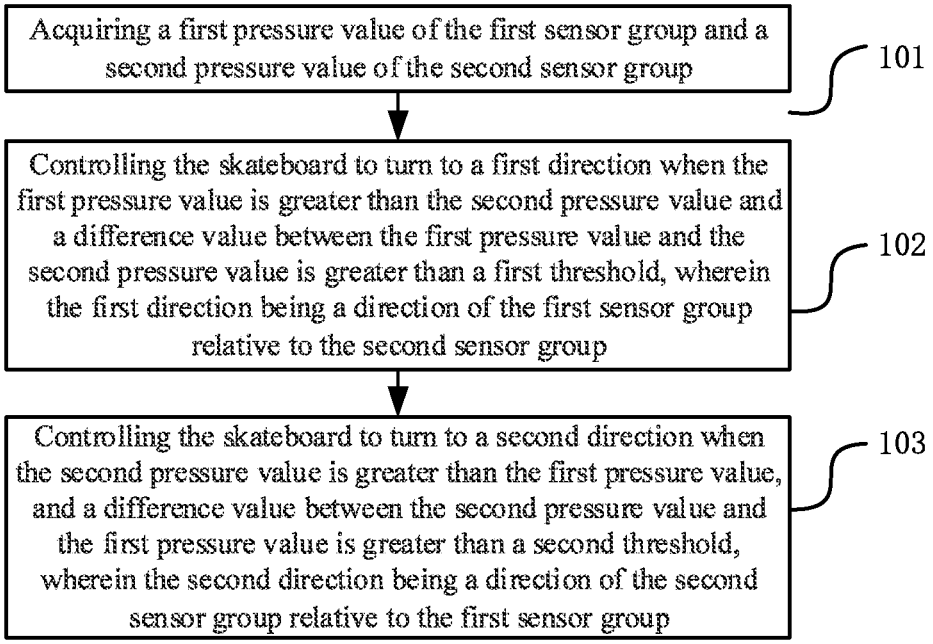
FIG. 1 is a flow chart showing a skateboard control method according to an exemplary aspect of the present disclosure.

FIG. 1 is a flow chart showing a skateboard control method according to an exemplary aspect. As shown in FIG. 1, the method is applied to a skateboard, wherein a skateboard deck of the skateboard is fixed on an axle of the skateboard, and a first sensor group and a second sensor group are sequentially arranged on the skateboard deck in the width direction; and the method include the following steps.

In step 101, a first pressure value of the first sensor group and a second pressure value of the second sensor group are acquired.

In step 102, the skateboard is controlled to turn to a first direction when the first pressure value is greater than the second pressure value and a difference value between the first pressure value and the second pressure value is greater than a first threshold, wherein the first direction being a direction of the first sensor group relative to the second sensor group.

In step 103, the skateboard is controlled to turn to a second direction when the second pressure value is greater than the first pressure value, and a difference value between the second pressure value and the first pressure value is greater than a second threshold, wherein the second direction being a direction of the second sensor group relative to the first sensor group.

In the method provided by the aspect of the present disclosure, the skateboard deck of the skateboard is fixed on the axle. The first sensor group and the second sensor group are sequentially arranged on the skateboard deck in the width direction. The skateboard is controlled to turn to the first direction of the first sensor group relative to the second sensor group when the first pressure value of the first sensor group is greater than the second pressure value of the second sensor group and the difference value between the first pressure value and the second pressure value is greater than the first threshold. The skateboard is controlled to turn to the second direction of the second sensor group relative to the first sensor group when the second pressure value is greater than the first pressure value and the difference value between the second pressure value and the first pressure value is greater than the second threshold. By fixing the skateboard deck of the skateboard on the axle, arranging a plurality of sensor groups on the skateboard deck in the width direction, and using the pressure difference values of the sensors to control the turning of the skateboard, so that the skateboard control method is more convenient, and both the safety and the learnability of the skateboard are improved.

In a possible implementation, a third sensor group and a fourth sensor group are sequentially arranged on the skateboard deck in the length direction; the third sensor group is arranged at the front half part of the skateboard deck; the fourth sensor group is arranged at the rear half part of the skateboard deck. The method further includes:

acquiring a third pressure value of the third sensor group and a fourth pressure value of the fourth sensor group;

controlling the skateboard to move forward when the third pressure value is greater than the fourth pressure value and a difference value between the third pressure value and the fourth pressure value is greater than a third threshold; and controlling the skateboard to brake when the fourth pressure value is greater than the third pressure value and a difference value between the fourth pressure value and the third pressure value is greater than a fourth threshold.

In a possible implementation, the four sensor groups cover a preset standing area of the skateboard deck; the first sensor group comprises a first sensor and a second sensor; the second sensor group comprises a third sensor and a fourth sensor; the third sensor group comprises the first sensor and the third sensor; and the fourth sensor group comprises the second sensor and the fourth sensor; and the first pressure value is a sum of pressure values of the first sensor and the second sensor; the second pressure value is a sum of pressure values of the third sensor and the fourth sensor; the third pressure value is a sum of pressure values of the first sensor and the third sensor; and the fourth pressure value is a sum of pressure values of the second sensor and the fourth sensor.

In a possible implementation, positions of any two sensor groups of the first sensor group, the second sensor group, the third sensor group and the fourth sensor group do not overlap one another; the four sensor groups cover a preset standing area of the skateboard deck; and each sensor group comprises at least one sensor.

In a possible implementation, the controlling the skateboard to turn to a first direction includes: determining a first turning angle corresponding to the difference value between the first pressure value and the second pressure value, and controlling the skateboard to turn to the first direction according to the first turning angle; and the controlling the skateboard to turn to a second direction includes: determining a second turning angle corresponding to the difference value between the second pressure value and the first pressure value, and controlling the skateboard to turn to the second direction according to the second turning angle.

In a possible implementation, the controlling the skateboard to turn to a first direction further includes: determining a first turning speed corresponding to the difference value between the first pressure value and the second pressure value, and controlling the skateboard to turn to the first direction according to the first turning speed; and the controlling the skateboard to turn to a second direction includes: determining a second turning speed corresponding to the difference value between the second pressure value and the first pressure value, and controlling the skateboard to turn to the second direction according to the second turning speed.

In a possible implementation, the controlling the skateboard to move forward includes:

determining a speed gear corresponding to the difference value between the third pressure value and the fourth pressure value; and controlling the skateboard to move forward at the speed gear, wherein the greater the difference value between the third pressure value and the fourth pressure value is, the higher a speed indicated by the corresponding speed gear is (i.e., a speed indicated by the corresponding speed gear is directly proportional to the difference value between the third pressure value and the fourth pressure value).

In a possible implementation, the controlling the skateboard to brake includes:

determining a braking torque corresponding to the difference value between the fourth pressure value and the third pressure value; and controlling the skateboard to brake according to the braking torque, wherein the greater the difference value between the fourth pressure value and the third pressure value is, the larger the corresponding braking torque is (i.e., the corresponding braking torque is directly proportional to the difference value between the fourth pressure value and the third pressure value).

In a possible implementation, the method further includes:

allowing the skateboard be controlled to slide when the pressure values of the first sensor group and the second sensor group are both greater than a preset starting value;

prohibiting the skateboard be controlled from sliding when the pressure values of the first sensor group and the pressure value of the second sensor group are both less than the preset starting value; and prohibiting the skateboard be controlled from sliding when one of the pressure value of the first sensor group and the pressure value of the second sensor group is less than the preset starting value.

In a possible implementation, the skateboard further comprises an electric motor; the electric motor is configured to drive the skateboard to carry out an operation which is one of moving straight and turning; and the electric motor is arranged on the skateboard in at least one form of that the electric motor is arranged on a shaft portion of the axle and the electric motor is an annular motor embedded on the inner side of a wheel portion of the axle.

All of the selectable technique solutions described above, may be selected in any combination to form alternative aspects of the present disclosure, and will not be described again herein.

Figure 2:
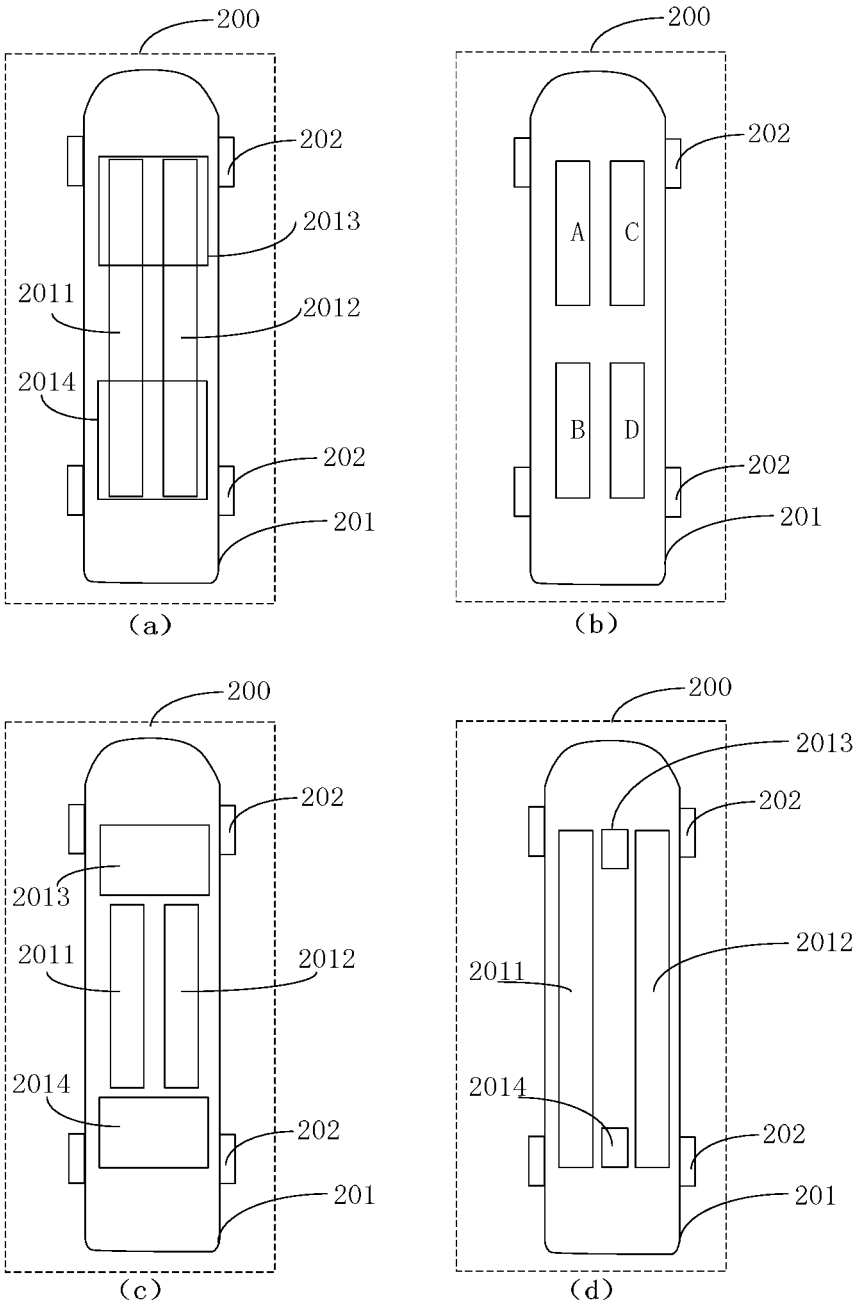
FIG. 2 is a schematic diagram illustrating a structure of a skateboard according to an exemplary aspect of the present disclosure.

FIG. 2 is a schematic diagram illustrating a structure of a skateboard according to an exemplary aspect. As shown in FIG. 2, a skateboard 200 comprises a skateboard deck 201 and an axle 202. The skateboard deck 201 is fixed on the axle 202. That is, the skateboard deck 201 of the skateboard cannot incline, and an angle between the skateboard deck 201 and the axle 202 is constant.

A first sensor group 2011 and a second sensor group 2012 are sequentially arranged on the skateboard deck 201 in the width direction. A third sensor group 2013 and a fourth sensor group 2014 are sequentially arranged on the skateboard deck 201 in the length direction. The third sensor group 2013 is arranged at the front half part of the skateboard deck 201. The fourth sensor group 2014 is arranged at the rear half part of the skateboard deck 201. It should be noted that, the positions of the first sensor group 2011, the second sensor group 2012, the third sensor group 2013, and the fourth sensor group 2014 on the skateboard deck 201 can cover a preset standing area of the skateboard deck 201. The preset standing area refers to a stepping range of a user's feet on the skateboard deck 201 of the skateboard 200. That is, when the user stands on the skateboard deck 201 of the skateboard 200, the user's feet fall into the coverage of the four sensor groups, so that the four sensor groups can comprehensively detect pressures of the user's feet onto different locations on the skateboard deck 201.

In the aspect of the present disclosure, the relative positions of the first sensor group 2011, the second sensor group 2012, the third sensor group 2013, and the fourth sensor group 2014 on the skateboard deck 201 may have the following two implementations.

In the first implementation, as shown in FIG. 2 (*a*), the first sensor group 2011 and the third sensor group 2013 include a same sensor, the first sensor group 2011 and the fourth sensor group 2014 include a same sensor, the second sensor group 2012 and the third sensor group 2013 include a same sensor, and the second sensor group 2012 and the fourth sensor group 2014 also include a same sensor. For example, as shown in FIG. 2 (*b*), the first sensor group 2011 comprises a first sensor A and a second sensor B. The second sensor group 2012 comprises a third sensor C and a fourth sensor D. The third sensor group 2013 comprises the first sensor A and the third sensor C. The fourth sensor group 2014 comprises the second sensor B and the fourth sensor D.

In the second aspect, as shown in FIG. 2 (*c*) or FIG. 2 (*d*), positions of any two sensor groups of the first sensor group 2011, the second sensor group 2012, the third sensor group 2013 and the fourth sensor group 2014 do not overlap one another. The four sensor groups cover the preset standing area of the skateboard deck 201. In this aspect, each sensor group comprises at least one sensor. Of course, each sensor may also comprise multiple sensors, which is not limited in this aspect.

The axle 202 comprises a front axle and a rear axle. In addition, the skateboard 200 further comprises an electric motor for driving the skateboard 200 to move. Wherein driving the skateboard 200 to move by the electric motor refers to driving the skateboard 200 to turn or move straight, and moving straight refers to moving forward and braking. In an implementation, the electric motor may be arranged on the front axle of the skateboard 200 to control the movement of the skateboard 200 by driving the front axle of the skateboard 200. In another implementation, the electric motor may be arranged on the rear axle of the skateboard 200 to control the movement of the skateboard 200 by driving the rear axle of the skateboard 200. In another implementation, both the front axle and the rear axle of the skateboard 200 may be embedded with an electric motor, respectively, which is not limited in this aspect. Here, the electric motor may be arranged on a shaft portion of the axle, or may be arranged on a wheel portion of the axle. For example, the electric motor is an annular motor which is embedded on the inner side of the wheel portion of the axle, and is embedded on a shaft with the wheel portion. The abrasion of the electric motor is reduced by embedding the electric motor on the inner side of the wheel portion, so that the durability of the skateboard 200 is improved, and the appearance of the skateboard 200 is more beautiful.

It should be noted that the skateboard 200 further comprises a power source for supplying power to the electric motor.

Based on the skateboard structure shown in FIG. 2, the aspect of the present disclosure provides a skateboard control method. The detailed flow of the method is shown in FIG. 3.

Figure 3:
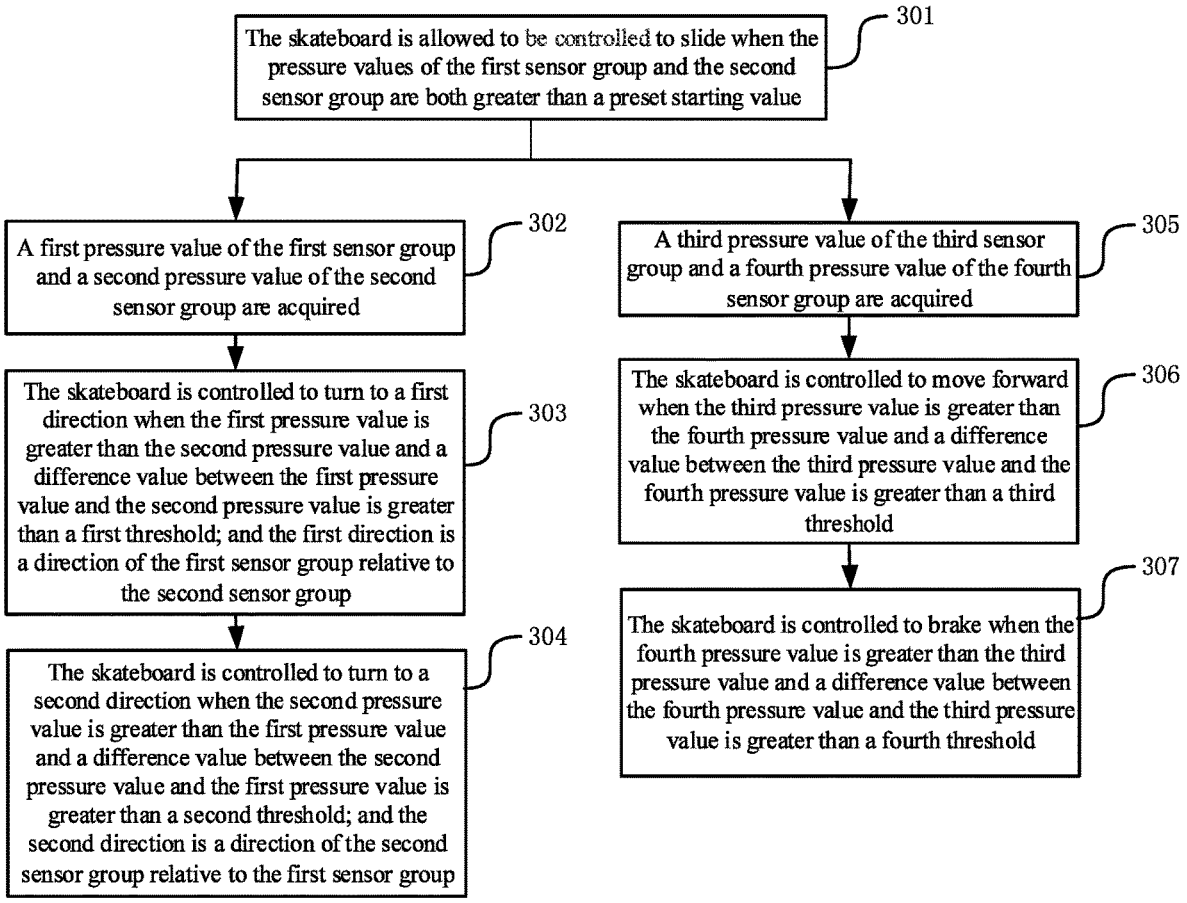
FIG. 3 is a flow chart showing a skateboard control method according to an exemplary aspect of the present disclosure.

FIG. 3 is a flow chart showing a skateboard control method according to an exemplary aspect. As shown in FIG. 3, the method is applied to a skateboard and comprises the steps as follows.

In step 301, the skateboard is allowed to be controlled to slide when the pressure values of the first sensor group and the second sensor group are both greater than a preset starting value.

The preset starting value may be a factory preset value of the skateboard, or may be set by a user according to his habit by providing a setting interface to the user, which is not limited in this aspect. It should be noted that the preset starting value is not less than zero. For example, the preset starting value may be equal to zero.

The skateboard is started and is allowed to be controlled through the following steps only when the pressure values of the first sensor group and the second sensor group are both greater than the preset starting value, so that the skateboard cannot slide until the user stands on the skateboard firmly. Therefore, the safety of the user is ensured, and the difficulty in learning skateboarding is reduced.

In addition, the user can set the preset starting value according to his habits, so that the safety of the skateboard in use is further ensured. For example, in order to prevent an infant from injury during playing the skateboard, the preset starting value may be set to be greater than a pressure value of the infant onto the skateboard deck, so that the skateboard cannot slide when the infant stands on the skateboard.

It should be noted that, in the aspect of the present disclosure, it is prohibited to control the skateboard to slide when the pressure value of the first sensor group and/or the pressure value of the second sensor group are/is less than the preset starting value. That is, when the pressure value of the first sensor group is less than the preset starting value, or the pressure value of the second sensor group is less than the preset starting value, or the pressure values of the first sensor group and the second sensor group are both less than the preset starting value, it is prohibited to control the skateboard to slide.

In the aspect of the present disclosure, the skateboard may be controlled to turn, move forward or brake according to the pressure values of the first sensor group, the second sensor group, the third sensor group and the fourth sensor group. The process of controlling the skateboard to turn comprises the following steps 302-304.

In step 302, a first pressure value of the first sensor group and a second pressure value of the second sensor group are acquired.

In the aspect of the present disclosure, after being started, the skateboard acquires the first pressure value of the first sensor group and the second pressure value of the second sensor group in real time.

In combination with FIG. 2 (*b*), when the first sensor group comprises the first sensor A and the second sensor B and the second sensor group comprises the third sensor C and the fourth sensor D, the first pressure value is a sum of pressure values of the first sensor A and the second sensor B;

and the second pressure value is a sum of pressure values of the third sensor C and the fourth sensor D.

In step 303, the skateboard is controlled to turn to a first direction when the first pressure value is greater than the second pressure value and a difference value between the first pressure value and the second pressure value is greater than a first threshold; and the first direction is a direction of the first sensor group relative to the second sensor group.

The first threshold may be preset or modified, which is not limited in this aspect.

The direction of the first sensor group relative to the second sensor group is explained in combination with FIG. 2 as follows. For example, when the first sensor group is located at the left side of the second sensor group, the direction of the first sensor group relative to the second sensor group is toward the left. That is, the direction of the first sensor group relative to the second sensor group is a direction toward which side of the second sensor group the first sensor group is located on, or in other words, it is a direction which is from the second sensor group toward the first sensor group.

In the aspect of the present disclosure, the process of controlling the skateboard to turn to the first direction comprises: determining a first turning angle corresponding to the difference value between the first pressure value and the second pressure value, and controlling the skateboard to turn to the first direction according to the first turning angle. Further, in the present disclosure, not only the turning angle but also the turning speed of the skateboard can be controlled when controlling the skateboard to turn. Therefore, the process of controlling the skateboard to turn to the first direction further comprises: determining a first turning speed corresponding to the difference value between the first pressure value and the second pressure value, and controlling the skateboard to turn to the first direction according to the first turning speed.

A corresponding relationship among the pressure difference value between the first pressure value and the second pressure value, the turning angle and the turning speed is preset in a control program of the skateboard, and indicates that the greater the pressure difference value is, the higher the turning angle and the turning speed are. During the movement of the skateboard, the first turning angle and the first turning speed corresponding to the difference value between the first pressure value and the second pressure value may be determined according to the difference value. Then, the electric motor is driven to control the skateboard to turn to the first direction according to the first turning angle and the first turning speed.

In step 304, the skateboard is controlled to turn to a second direction when the second pressure value is greater than the first pressure value and a difference value between the second pressure value and the first pressure value is greater than a second threshold; and the second direction is a direction of the second sensor group relative to the first sensor group.

The second threshold may be preset or modified, and may be the same with or different from the first threshold, which is not limited in this aspect.

The direction of the second sensor group relative to the first sensor group is explained in combination with FIG. 2 as follows. For example, when the second sensor group is located at the right side of the first sensor group, the direction of the second sensor group relative to the first sensor group is toward the right. That is, the direction of the second sensor group relative to the first sensor group is a direction toward which side of the first sensor group the second sensor group is located on, or in other words, it is a direction which is from the first sensor group toward the second sensor group.

In the aspect of the present disclosure, the process of controlling the skateboard to turn to the second direction comprises: determining a second turning angle corresponding to the difference value between the second pressure value and the first pressure value, and controlling the skateboard to turn to the second direction according to the second turning angle. Further, in the present disclosure, not only the turning angle but also the turning speed of the skateboard can be controlled when controlling the skateboard to turn. Therefore, the process of controlling the skateboard to turn to the second direction further comprises: determining a second turning speed corresponding to the difference value between the second pressure value and the first pressure value, and controlling the skateboard to turn to the second direction according to the second turning speed.

A corresponding relationship among the pressure difference value between the second pressure value and the first pressure value, the turning angle and the turning speed is preset in a control program of the skateboard, and indicates that the greater the absolute value of the pressure difference value is, the higher the turning angle and the turning speed are. During the movement of the skateboard, the second turning angle and the second turning speed corresponding to the difference value between the second pressure value and the first pressure value may be determined according to the difference value. Then, the electric motor is driven to control the skateboard to turn to the second direction according to the second turning angle and the second turning speed.

In the aspect of the present disclosure, the process of controlling the skateboard to move forward or brake comprises the following steps 305-307.

In step 305, a third pressure value of the third sensor group and a fourth pressure value of the fourth sensor group are acquired.

In the aspect of the present disclosure, after being started, the skateboard acquires the third pressure value of the third sensor group and the fourth pressure value of the fourth sensor group in real time.

It should be noted that after the skateboard is started, the step 305 and the step 302 may be performed simultaneously. That is, after being started, the skateboard monitors the pressure values of the all sensors on the skateboard deck in real time.

In combination with FIG. 2(*b*), when the third sensor group comprises the first sensor A and the third sensor C, and the fourth sensor group comprises the second sensor B and the fourth sensor D, the third pressure value is a sum of pressure values of the first sensor A and the third sensor C; and the fourth pressure value is a sum of pressure values of the second sensor B and the fourth sensor D.

In step 306, the skateboard is controlled to move forward when the third pressure value is greater than the fourth pressure value and a difference value between the third pressure value and the fourth pressure value is greater than a third threshold.

The third threshold may be preset or modified, which is not limited in this aspect.

In the aspect of the present disclosure, the process of controlling the skateboard to move forward comprises: determining a speed gear corresponding to the difference value between the third pressure value and the fourth pressure value; and controlling the skateboard to move forward at the speed gear.

A corresponding relationship between the pressure difference value between the third pressure value and the fourth pressure value and the speed gear is preset in a control program of the skateboard, and indicates that the greater the pressure difference value between the third pressure value and the fourth pressure value is, the higher a speed indicated by the corresponding speed gear is. Taking FIG. 2(*b*) as an example, the greater the difference value between the sensors A and C and the sensors B and D is, the higher the speed of the skateboard when moving forward is.

In step 307, the skateboard is controlled to brake when the fourth pressure value is greater than the third pressure value and a difference value between the fourth pressure value and the third pressure value is greater than a fourth threshold.

The fourth threshold may be preset or modified, and may be the same with or different from the third threshold, which is not limited in this aspect.

In the aspect of the present disclosure, the process of controlling the skateboard to brake comprises: determining a braking torque corresponding to the difference value between the fourth pressure value and the third pressure value; and controlling the skateboard to brake according to the braking torque.

A corresponding relationship between the pressure difference value between the fourth pressure value and the third pressure value and the braking torque is preset in a control program of the skateboard, and indicates that the greater the pressure difference value between the fourth pressure value and the third pressure value is, the larger the corresponding braking torque is. It should be noted that the larger the braking torque is, the greater the friction of the skateboard when braking is, and the shorter the braking distance at the same speed is. Taking FIG. 2 (*b*) as an example, the greater the pressure difference value between the sensors B and D and the sensors A and C is, the larger the braking torque is.

The above process is further explained by taking the layout of sensors shown in FIG. 2(*b*) as an example.

Assume the pressure value of the first sensor A is a, the pressure value of the second sensor B is b, the pressure value of the third sensor C is c, and the pressure value of the fourth sensor D is d.

The skateboard is controlled to be started and is allowed to be controlled to slide when (a+b+c+d) is greater than the preset starting value;

the skateboard is controlled to turn to the left according to a turning angle and a turning speed corresponding to a difference value between (a+b) and (c+d) when (a+b)−(c+d) is greater than the first threshold;

the skateboard is controlled to turn to the right according to a turning angle and a turning speed corresponding to a difference value between (c+d) and (a+b) when (c+d)−(a+b) is greater than the second threshold;

the skateboard is controlled to move forward according to a speed gear corresponding to a difference value between (a+c) and (b+d) when (a+c)−(b+d) is greater than the third threshold;

the skateboard is controlled to brake according to a braking torque corresponding to a difference value between (b+d) and (a+c) when (b+d)−(a+c) is greater than the fourth threshold; and the skateboard is stopped to prohibit from sliding when (a+b+c+d) is less than the preset starting value.

In the method provided by the aspect of the present disclosure, the skateboard deck of the skateboard is fixed on the axle. The first sensor group and the second sensor group are sequentially arranged on the skateboard deck in the width direction. The skateboard is controlled to turn to the first direction of the first sensor group relative to the second sensor group when the first pressure value of the first sensor group is greater than the second pressure value of the second sensor group and the difference value between the first pressure value and the second pressure value is greater than the first threshold. The skateboard is controlled to turn to the second direction of the second sensor group relative to the first sensor group when the second pressure value is greater than the first pressure value and the difference value between the second pressure value and the first pressure value is greater than the second threshold. By fixing the skateboard deck of the skateboard on the axle, arranging a plurality of sensor groups on the skateboard deck in the width direction, and using the pressure difference values of the sensors to control the turning of the skateboard, so that the skateboard control method is more convenient, and both the safety and the learnability of the skateboard are improved.

In addition, by arranging the plurality of sensor groups on the skateboard deck in the length direction, and using the pressure difference values of the sensors to control the skateboard to move forward and brake, so that the comprehensiveness and flexibility of a control function of the skateboard are improved.

Further, different control parameters such as a turning angle, a turning speed, a forward speed, and a braking torque can be set according to a pressure difference, so that the intelligence in the control of the skateboard is improved.

In an exemplary aspect, there is also provided a computer-readable storage medium in which instructions are stored. When the instructions in the storage medium are executed by a processor of the skateboard, the skateboard can perform the above skateboard control method.

It is noted that the various modules, sub-modules, units, and components in the present disclosure can be implemented using any suitable technology. For example, a module may be implemented using circuitry, such as an integrated circuit (IC). As another example, a module may be implemented as a processing circuit executing software instructions.

Other aspects of the present disclosure will be apparent to those skilled in the art from consideration of the specification and practice of the present disclosure here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A skateboard control method, applied to a skateboard, wherein a skateboard deck of the skateboard is fixed on an axle of the skateboard, and a first sensor group and a second sensor group are sequentially arranged on the skateboard deck in a width direction, the method comprising:

acquiring a first pressure value of the first sensor group and a second pressure value of the second sensor group;

controlling the skateboard to turn to a first direction when the first pressure value is greater than the second pressure value and a difference value between the first pressure value and the second pressure value is greater than a first threshold, wherein the first direction is a direction of the first sensor group relative to the second sensor group; and controlling the skateboard to turn to a second direction when the second pressure value is greater than the first pressure value and a difference value between the second pressure value and the first pressure value is greater than a second threshold, wherein the second direction is a direction of the second sensor group relative to the first sensor group, wherein controlling the skateboard to turn to the first direction comprises: determining a first turning angle corresponding to the difference value between the first pressure value and the second pressure value, and controlling the skateboard to turn to the first direction based on the first turning angle; and wherein controlling the skateboard to turn to the second direction comprises: determining a second turning angle corresponding to the difference value between the second pressure value and the first pressure value, and controlling the skateboard to turn to the second direction based on the second turning angle.

2. The method according to claim 1, wherein a third sensor group and a fourth sensor group are sequentially arranged on the skateboard deck in a length direction, the third sensor group is arranged at a front half part of the skateboard deck, the fourth sensor group is arranged at a rear half part of the skateboard deck, the method further comprising:

acquiring a third pressure value of the third sensor group and a fourth pressure value of the fourth sensor group;

controlling the skateboard to move forward when the third pressure value is greater than the fourth pressure value and a difference value between the third pressure value and the fourth pressure value is greater than a third threshold; and controlling the skateboard to brake when the fourth pressure value is greater than the third pressure value and a difference value between the fourth pressure value and the third pressure value is greater than a fourth threshold.

3. The method according to claim 2, wherein the first, second, third, and fourth sensor groups cover a preset standing area of the skateboard deck, the first sensor group comprises a first sensor and a second sensor, the second sensor group comprises a third sensor and a fourth sensor, the third sensor group comprises the first sensor and the third sensor, and the fourth sensor group comprises the second sensor and the fourth sensor, and wherein the first pressure value is a sum of pressure values of the first sensor and the second sensor, the second pressure value is a sum of pressure values of the third sensor and the fourth sensor, the third pressure value is a sum of pressure values of the first sensor and the third sensor, and the fourth pressure value is a sum of pressure values of the second sensor and the fourth sensor.

4. The method according to claim 2, wherein controlling the skateboard to move forward comprises:

determining a speed gear corresponding to the difference value between the third pressure value and the fourth pressure value; and controlling the skateboard to move forward at the speed gear, wherein a speed indicated by the corresponding speed gear is directly proportional to the difference value between the third pressure value and the fourth pressure value.

5. The method according to claim 2, wherein controlling the skateboard to brake comprises:

determining a braking torque corresponding to the difference value between the fourth pressure value and the third pressure value; and controlling the skateboard to brake based on the braking torque, wherein the corresponding braking torque is directly proportional to the difference value between the fourth pressure value and the third pressure value.

6. The method according to claim 1, wherein controlling the skateboard to turn to the first direction further comprises: determining a first turning speed corresponding to the difference value between the first pressure value and the second pressure value, and controlling the skateboard to turn to the first direction based on the first turning speed; and wherein controlling the skateboard to turn to the second direction comprises: determining a second turning speed corresponding to the difference value between the second pressure value and the first pressure value, and controlling the skateboard to turn to the second direction based on the second turning speed, and controlling the skateboard to turn to the second direction based on the second turning speed.

7. The method according to claim 1, further comprising:

allowing the skateboard to slide when the pressure values of the first sensor group and the second sensor group are both greater than a preset starting value;

prohibiting the skateboard from sliding when the pressure values of the first sensor group and the pressure value of the second sensor group are both less than the preset starting value; and prohibiting the skateboard from sliding when one of the pressure value of the first sensor group and the pressure value of the second sensor group is less than the preset starting value.

8. The method according to claim 1, wherein the skateboard further comprises an electric motor that is configured to drive the skateboard to carry out an operation that is one of moving straight and turning, and wherein the electric motor is arranged on the skateboard on a shaft portion of the axle.

9. A skateboard, comprising:

an axle;

a skateboard deck fixed on the axle; and a first sensor group and a second sensor group sequentially arranged on the skateboard deck in a width direction, wherein the first sensor group is configured to acquire a first pressure value, and the second sensor group is configured to acquire a second pressure value, wherein the skateboard is configured to turn to a first direction when the first pressure value is greater than the second pressure value and a difference value between the first pressure value and the second pressure value is greater than a first threshold, wherein the first direction is a direction of the first sensor group relative to the second sensor group, wherein the skateboard is configured to turn to a second direction when the second pressure value is greater than the first pressure value and a difference value between the second pressure value and the first pressure value is greater than a second threshold, wherein the second direction is a direction of the second sensor group relative to the first sensor group, wherein the skateboard is further configured to determine a first turning angle corresponding to the difference value between the first pressure value and the second pressure value, and control the skateboard to turn to the first direction based on the first turning angle, and wherein the skateboard is further configured to determine a second turning angle corresponding to the difference value between the second pressure value and the first pressure value, and control the skateboard to turn to the second direction based on the second turning angle.

10. The skateboard according to claim 9, wherein a third sensor group and a fourth sensor group are sequentially arranged on the skateboard deck in a length direction, the third sensor group is arranged at a front half part of the skateboard deck, the fourth sensor group is arranged at a rear half part of the skateboard deck, and wherein the skateboard is configured to:

acquire a third pressure value of the third sensor group and a fourth pressure value of the fourth sensor group;

control the skateboard to move forward when the third pressure value is greater than the fourth pressure value and a difference value between the third pressure value and the fourth pressure value is greater than a third threshold; and control the skateboard to brake when the fourth pressure value is greater than the third pressure value and a difference value between the fourth pressure value and the third pressure value is greater than a fourth threshold.

11. The skateboard according to claim 10, wherein the first, second, third, and fourth sensor groups cover a preset standing area of the skateboard deck, the first sensor group comprises a first sensor and a second sensor, the second sensor group comprises a third sensor and a fourth sensor, the third sensor group comprises the first sensor and the third sensor, and the fourth sensor group comprises the second sensor and the fourth sensor, and wherein the first pressure value is a sum of pressure values of the first sensor and the second sensor, the second pressure value is a sum of pressure values of the third sensor and the fourth sensor, the third pressure value is a sum of pressure values of the first sensor and the third sensor, and the fourth pressure value is a sum of pressure values of the second sensor and the fourth sensor.

12. The skateboard according to claim 10, wherein positions of any two sensor groups of the first sensor group, the second sensor group, the third sensor group, and the fourth sensor group do not overlap one another, wherein the first, second, third, and fourth sensor groups cover a preset standing area of the skateboard deck, and wherein each of the first, second, third, and fourth sensor groups comprises at least one sensor.

13. The skateboard according to claim 10, wherein the skateboard is configured to:

determine a speed gear corresponding to the difference value between the third pressure value and the fourth pressure value; and control the skateboard to move forward at the speed gear, wherein a speed indicated by the corresponding speed gear is directly proportional to the difference value between the third pressure value and the fourth pressure value.

14. The skateboard according to claim 10, wherein the skateboard is configured to:

determine a braking torque corresponding to the difference value between the fourth pressure value and the third pressure value; and control the skateboard to brake based on the braking torque, wherein the corresponding braking torque is directly proportional to the difference value between the fourth pressure value and the third pressure value.

15. The skateboard according to claim 9, wherein the skateboard is further configured to determine a first turning speed corresponding to the difference value between the first pressure value and the second pressure value, and control the skateboard to turn to the first direction based on the first turning speed, and wherein the skateboard is further configured to determine a second turning speed corresponding to the difference value between the second pressure value and the first pressure value, and control the skateboard to turn to the second direction based on the second turning speed.

16. The skateboard according to claim 9, wherein the skateboard is further configured to:

allow the skateboard to slide when the pressure values of the first sensor group and the second sensor group are both greater than a preset starting value;

prohibit the skateboard from sliding when the pressure values of the first sensor group and the pressure value of the second sensor group are both less than the preset starting value; and prohibit the skateboard from sliding when one of the pressure value of the first sensor group and the pressure value of the second sensor group is less than the preset starting value.

17. The skateboard according to claim 9, wherein the skateboard further comprises an electric motor that is configured to drive the skateboard to carry out an operation that is one of moving straight and turning, and wherein the electric motor is an annular motor embedded on an inner side of a wheel portion of the axle.

18. A non-transitory computer-readable storage medium having stored therein instructions that, when executed by a processor of a skateboard having a skateboard deck that is fixed on an axle of the skateboard, and a first sensor group and a second sensor group that are sequentially arranged on the skateboard deck in a width direction, cause the skateboard to:

acquire a first pressure value of the first sensor group and a second pressure value of the second sensor group;

control the skateboard to turn to a first direction when the first pressure value is greater than the second pressure value and a difference value between the first pressure value and the second pressure value is greater than a first threshold, wherein the first direction is a direction of the first sensor group relative to the second sensor group; and control the skateboard to turn to a second direction when the second pressure value is greater than the first pressure value and a difference value between the second pressure value and the first pressure value is greater than a second threshold, wherein the second direction is a direction of the second sensor group relative to the first sensor group, wherein controlling the skateboard to turn to the first direction comprises: determining a first turning angle corresponding to the difference value between the first pressure value and the second pressure value, and controlling the skateboard to turn to the first direction based on the first turning angle; and wherein controlling the skateboard to turn to the second direction comprises: determining a second turning angle corresponding to the difference value between the second pressure value and the first pressure value, and controlling the skateboard to turn to the second direction based on the second turning angle.

* * * * *